US009821317B1

(12) United States Patent
Canterbury

(10) Patent No.: US 9,821,317 B1
(45) Date of Patent: Nov. 21, 2017

(54) RECLAIM GATE FOR A CEMENT TRUCK

(71) Applicant: David B. Canterbury, Tulsa, OK (US)

(72) Inventor: David B. Canterbury, Tulsa, OK (US)

( * ) Notice: Subject to any disclaimer, the term of this patent is extended or adjusted under 35 U.S.C. 154(b) by 0 days.

(21) Appl. No.: 14/993,020

(22) Filed: Jan. 11, 2016

Related U.S. Application Data

(60) Provisional application No. 62/101,512, filed on Jan. 9, 2015.

(51) Int. Cl.

| | |
|---|---|
| ***B07B 9/00*** | (2006.01) |
| ***B03B 5/48*** | (2006.01) |
| ***B03B 9/06*** | (2006.01) |
| ***B28C 5/08*** | (2006.01) |

(52) U.S. Cl.
CPC ..... *B03B 5/48* (2013.01); *B03B 9/063* (2013.01); *B28C 5/0887* (2013.01)

(58) Field of Classification Search
CPC ..... B03B 9/063; B03B 5/41; B03B 5/0887
USPC ..... 209/17
See application file for complete search history.

(56) References Cited

U.S. PATENT DOCUMENTS

| | | | | |
|---|---|---|---|---|
| 2,836,299 | A | 5/1958 | Johnson | |
| 2,942,731 | A | 6/1960 | Soldini | |
| 3,596,759 | A | 8/1971 | King et al. | |
| 4,127,478 | A | 11/1978 | Miller | |
| 4,207,176 | A * | 6/1980 | Hood | B03B 5/56 209/44 |
| 5,064,535 | A * | 11/1991 | Hsu | A47J 47/005 210/380.1 |
| 5,127,740 | A | 7/1992 | DeBoer | |
| 5,695,280 | A | 12/1997 | Baker et al. | |
| 6,682,655 | B2 | 1/2004 | Beckham et al. | |
| 6,782,925 | B2 * | 8/2004 | Raposo | B03B 9/063 141/11 |
| 6,866,047 | B1 * | 3/2005 | Marvin | B01F 13/0035 134/111 |
| 7,258,737 | B2 | 8/2007 | Chang | |
| 7,594,524 | B2 * | 9/2009 | DeCollibus | B03B 9/063 134/104.4 |
| 7,802,914 | B2 * | 9/2010 | Khouri | B28C 5/0831 366/59 |
| 8,287,173 | B2 * | 10/2012 | Khouri | B01F 9/06 366/44 |
| 2014/0042656 | A1 | 2/2014 | Schuran | |

* cited by examiner

*Primary Examiner* — Terrell Matthews
(74) *Attorney, Agent, or Firm* — Robert C Montgomery; Montgomery Patent & Design

(57) ABSTRACT

A method and apparatus for separating components of wet cement. A reclaim gate includes a tumbler flange with a tumbler flange opening. A strainer having strainer openings passes sand, rinse water, and cement slurry while blocking cement aggregates. A fixed plate entraps the strainer in place. The fixed plate has a reclaim aperture aligned with the screen. A rotating turn plate having a matching reclaim aperture is adjacent the fixed plate. A gate actuator retains the turn plate adjacent the fixed plate such that the turn plate can turn to selectively align the turn plate aperture with the fixed plate aperture. In use the aggregates are blocked by the screen, the sand passes through and is filtered; the slurry passes through and is collected and settled. The aggregates, sand, and rinse water can be recovered.

13 Claims, 3 Drawing Sheets

RECLAIM GATE FOR A CEMENT TRUCK

RELATED APPLICATIONS

This application claims the benefit of U.S. Provisional Application No. 62/101,512, which was filed Jan. 9, 2015, the entire disclosures of which are incorporated herein by reference.

FIELD OF THE INVENTION

The presently disclosed subject matter is directed to concrete. More particularly, it is directed to recycling wet cement located in ready-mix trucks to separate sand, concrete slurry, and concrete aggregates from the wet cement.

BACKGROUND OF THE INVENTION

The use of concrete as a building material has exploded in recent years. Nowadays it is not at all uncommon to find concrete used not only in driveways and sidewalks but also in building construction, patios, retaining walls, and the like. Concrete's long life coupled with no-care beauty and affordable cost make it a very popular material for many such applications.

Concrete is often delivered to project sites by ready-mix concrete trucks. As it can be difficult to determine exactly how much concrete is needed for a particular job and since no one wants to run out of concrete during a pour it is not at all uncommon for a job site to order more ready-mix concrete then is needed and then to return the excess to the concrete plant. Such excess concrete is usually separated back into its constituent components using an on-site concrete re-claimer. That way the concrete can be used in future concrete batches.

On-site re-claimers are generally expensive, require a separate power source, and are fixed regarding their location and ability to handle multiple trucks. Accordingly, there exists a need for an apparatus and a method of reclaiming concrete from ready-mix concrete trucks without using a fixed site concrete re-claimer. Ideally such a concrete recycling apparatus and method would provide for reclaiming concrete directly from ready-mix concrete trucks in a manner which is quick, easy, and effective.

SUMMARY OF THE INVENTION

The principles of the present invention provide for an apparatus and method for reclaiming excess concrete from ready-mix concrete trucks. That apparatus and method avoids the need for a dedicated fixed site concrete re-claimer while enabling quick, easy and effective reclaiming of mixed concrete.

According to one (1) aspect the invention takes the form of a reclaim gate having a tumbler flange with a tumbler flange opening, a strainer adjacent the tumbler flange ad having a central strainer pivot aperture and a screen with strainer openings, and a fixed plate entrapping the strainer adjacent the tumbler flange. The fixed plate is rigidly attached to the tumbler flange by threaded fasteners. The fixed plate includes a central fixed plate aperture and a fixed plate reclaim aperture that is aligned with the screen. A rotating turn plate having a central turn plate aperture and a turn plate reclaim aperture is adjacent the fixed plate. A gate actuator passes through the central turn plate aperture, through the central fixed plate aperture and into the central strainer pivot aperture so as to retain the turn plate adjacent the fixed plate such that the turn plate can turn to selectively align the central turn plate aperture with the central fixed plate aperture.

In practice the tumbler flange includes threaded fastener apertures for receiving the threaded fasteners. Beneficially the tumbler flange is welded to a truck. The strainer openings should not be large enough to allow wet cement aggregates to pass through but large enough to allow sand, slurry, and rinse water to pass through. The fixed plate may include an "L"-shaped perimeter for entrapping the strainer adjacent the tumbler flange. Preferably the central turn plate aperture includes a keyway and the gate actuator includes a key that fits into the keyway such that turning the gate actuator turns the turn plate. A nut fastener can retain the gate actuator to the fixed plate and to the turn plate.

According to another aspect the invention takes the form of a ready mix cement truck having a rotating tumbler on a truck frame and having a tumbler aperture. A tumbler flange having a tumbler flange opening is aligned with the tumbler aperture. The tumbler flange is permanently attached to the tumbler. Also included is a strainer adjacent the tumbler flange with the strainer having a central strainer pivot aperture and a screen having strainer openings. A fixed plate entraps the strainer adjacent the tumbler flange. The fixed plate is rigidly attached to the tumbler flange by threaded fasteners. The fixed plate includes a central fixed plate aperture and a fixed plate reclaim aperture that is aligned with the screen. A rotating turn plate having a central turn plate aperture and a turn plate reclaim aperture is adjacent the fixed plate. A gate actuator passes through the central turn plate aperture, through the central fixed plate aperture and into the central strainer pivot aperture to retain the turn plate adjacent the fixed plate such that the turn plate can turn to selectively align the central turn plate aperture with the central fixed plate aperture.

In practice the tumbler flange includes threaded fastener apertures for receiving the threaded fasteners. Beneficially the tumbler flange is welded to the truck. The strainer openings should not be large enough to allow wet cement aggregates to pass through but large enough to allow sand, slurry, and rinse water to pass through. The fixed plate may include an "L"-shaped perimeter for entrapping the strainer adjacent the tumbler flange. Preferably the central turn plate aperture includes a keyway while the gate actuator includes a key that fits into the keyway such that turning the gate actuator turns the turn plate. A nut fastener can be used to retain the gate actuator to the fixed plate and to the turn plate.

According to yet another aspect the invention takes the form of a method for reclaiming sand and concrete aggregates from wet cement located in a ready mix cement truck. That method is practiced by locating a ready mix cement truck having a tumbler adjacent a reclaim area and then rotating the tumbler to enable constituent components of wet cement to come out of an opening. Next, a screen having screen openings that are too small for concrete aggregates to pass through is located adjacent the opening. The wet cement in the tumbler is then rinsed with rinse water to dilute the wet cement. Sand, concrete slurry, and rinse water is then allowed to pass through the screen openings and into the reclaim area. Sand is then filtered out in the reclaim area such that the sand remains in the reclaim area. The slurry and rinse water are passed through a reclaim area filter and the slurry and rinse water are collected. The slurry is allowed to settle out and the sand, rinse water, and cement aggregate are recovered.

In practice the reclaim area has a non-permeable surface while reclaim filtering uses a hay bale perimeter around the reclaim. A secondary filter can then be placed on the hay bale perimeter and the hay bales can be stabilized in place.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
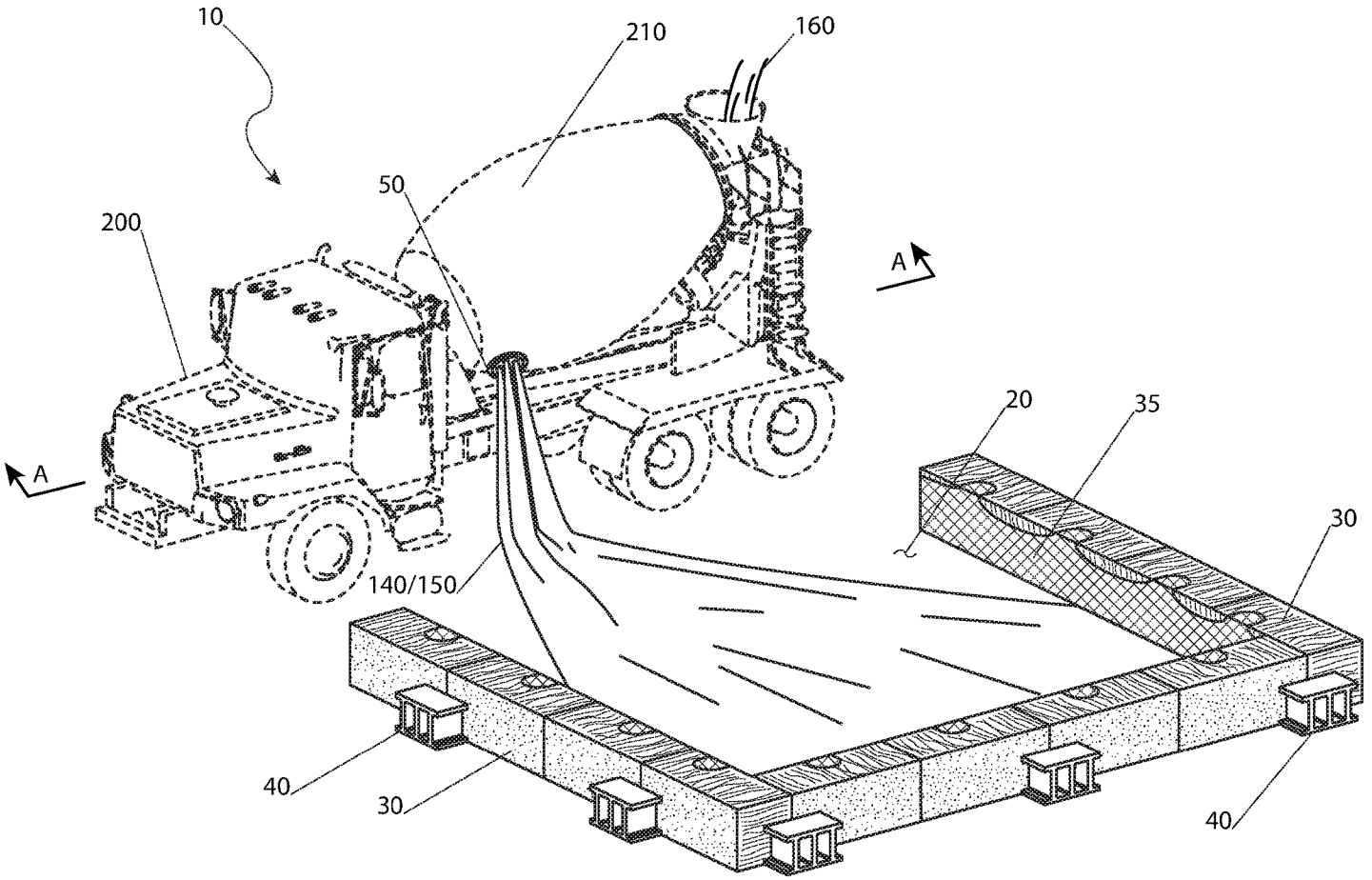
FIG. 1 is an isometric view of a cement truck 200 at a reclaim area 20 which is engaged in an inventive recycling method 10 that is in accordance with the preferred embodiment of the present invention.

10 method
20 reclaim area
30 hay bales
35 silt fence/reclamation structure
40 stabilizer blocks
50 reclaim gate
55 tumbler flange aperture
60 tumbler flange
62 weld
65 fastener aperture
70 strainer
75 strainer reclaim aperture
77 strainer pivot aperture
80 fixed plate
85 fixed plate reclaim aperture
90 plate fastener
95 fixed plate pivot aperture
100 turn plate
105 turn plate reclaim aperture
110 turn plate pivot aperture
112 keyway
113 perimeter edge
115 gate actuator
117 key
118 threaded region
120 nut fastener
125 actuator tool
130 aggregate
140 sand
150 slurry
160 rinse water
200 cement truck
210 tumbler
215 tumbler aperture

DETAILED DESCRIPTION OF THE PREFERRED EMBODIMENT

Figure 2:
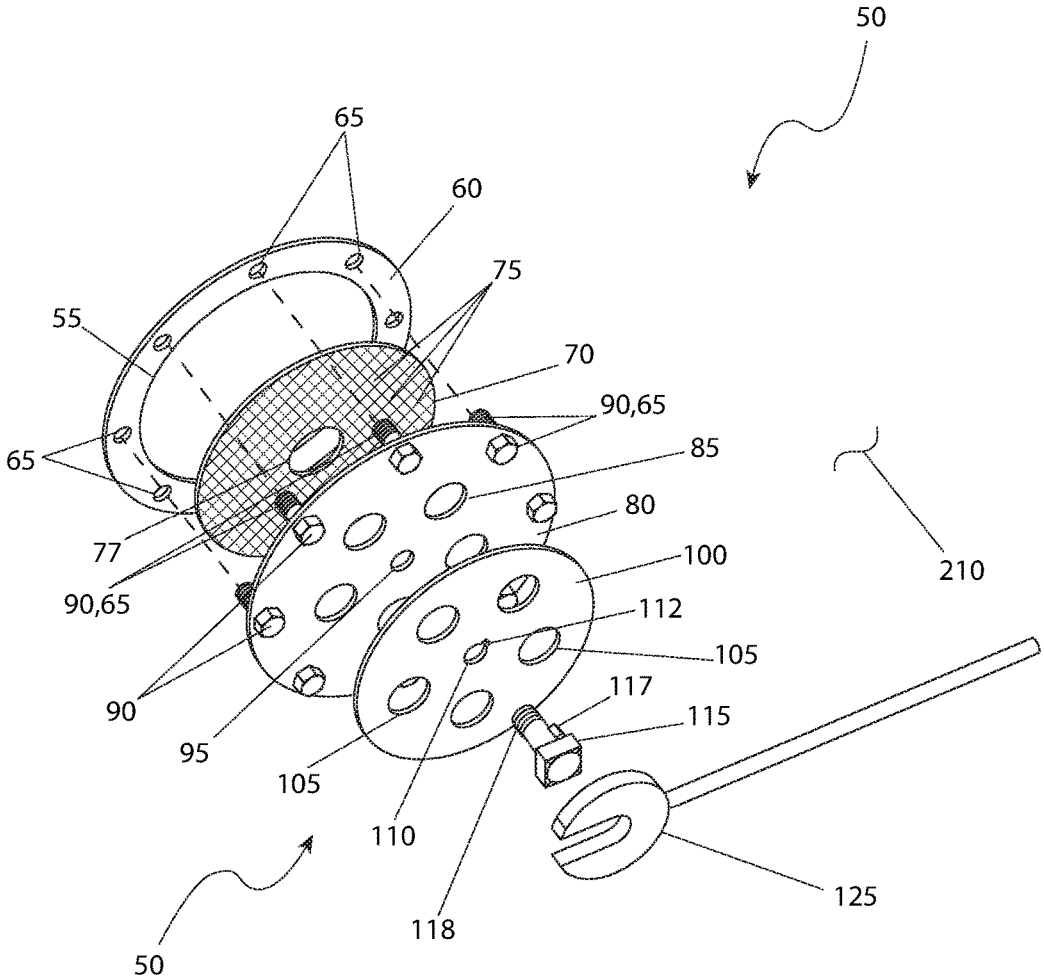
FIG. 2 is an exploded view of an inventive reclaim gate 50 on a tumbler 210 of a cement truck 200 that is useful when practicing the recycling method 10; and, FIG. 3 is a sectional view of the reclaim gate 50.
Figure 3:
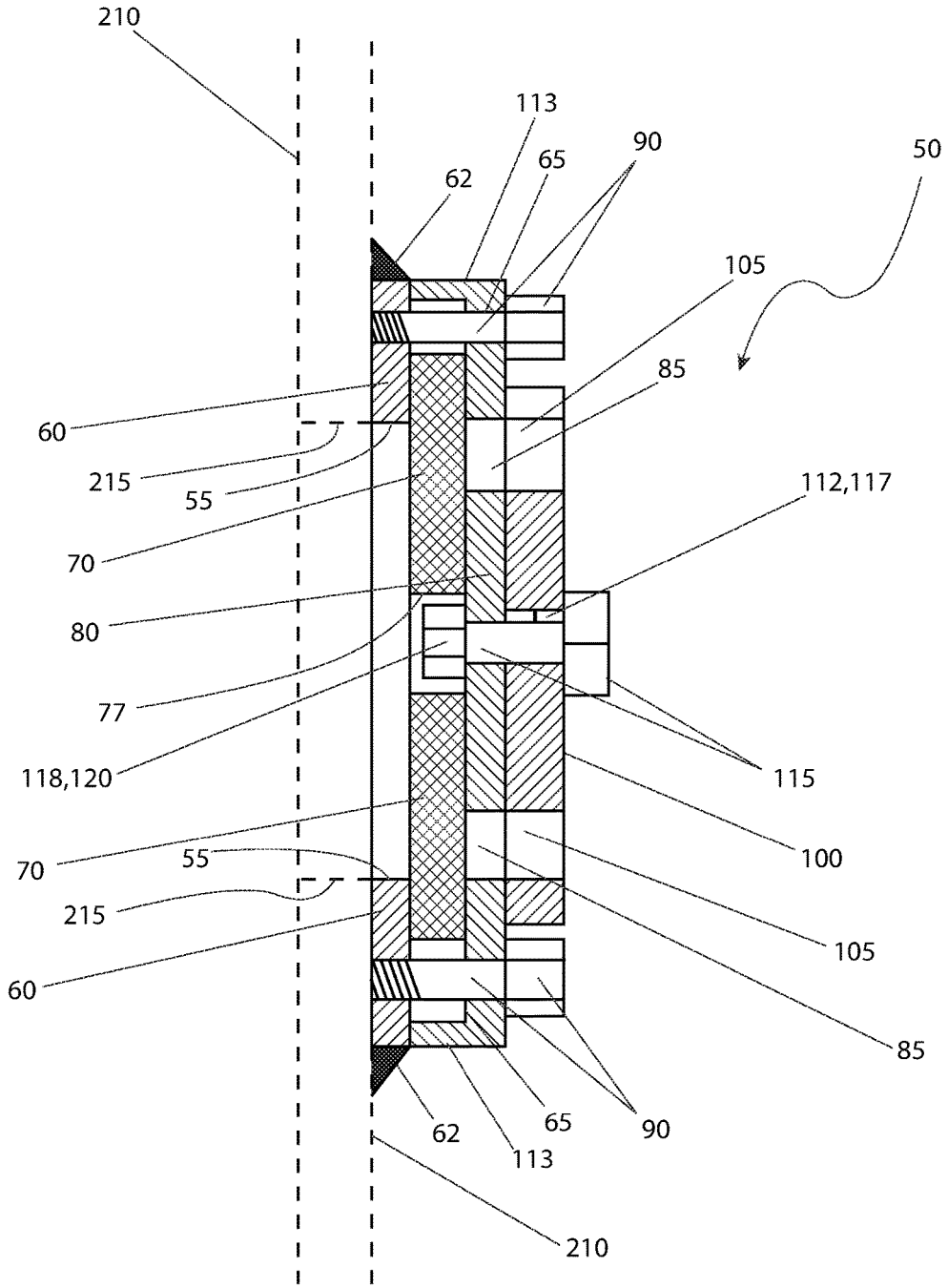

The preferred embodiment of the present invention is herein depicted within FIGS. 1 through 3. However, the invention is not limited to the specifically described embodiment. A person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" as used herein do not denote a limitation of quantity, but rather denote the presence of at least one (1) of the referenced items.

Referencing FIGS. 1-3, the present invention describes a cement recycling method 10 and a reclaim gate 50 that is suitable for practicing the method 10. The method 10 achieves separation of a batch of mixed cement into its constituent components, specifically an aggregate 130, sand 140, and a portland/water slurry 150. The aggregate 130, namely gravel, remains within a tumbler 210 of a ready-mix cement truck 200 while the sand 140 and the slurry 150 are rinsed from the tumbler 210 using rinse water 160. Upon exiting the reclaim gate 50 the constituents of the sand 140 and slurry 150 enter an adjacent reclaim area 20 for further processing such as, but not limited to: filtering, disposal, storage, and collection.

FIG. 1 presents an isometric view of a ready mix cement truck 200 at a reclaim area 20. The cement truck 200 is understood as containing wet cement. The cement truck 200 is parked in proximity to the reclaim area 20 with the tumbler 210 oriented such that the reclaim gate 50 is in the lowest position on the tumbler 210. Rinse water 160 is introduced into the tumbler 210 for washing and diluting the wet cement. With the wet cement diluted the constituent sand 140, slurry 150, and the rinse water 160 can pass through the reclaim gate 50 when the reclaim gate 50 is open and then into the reclaim area 20. The aggregate 130 remains in the tumbler 210.

The reclaim area 20 is beneficially a paved area having a downward slope that runs toward hay bales 30 arranged in a semi-enclosed pattern. A fence/reclamation structure 35 comprised of something like a synthetic geotextile material for filtering water in sediment control projects is draped over the inner periphery of the hay bales 30. The hay bales 30 reinforce the fence/reclamation structure 35 while also providing another layer of filtration. The hay bales 30 may be arranged as depicted in FIG. 1, bounding three (3) sides of a rectangular area, or they may be placed in any arcuate or semi-circular configuration to suit a particular reclaim area 20. The hay bales can be reinforced by blocks 40.

The dislodged sand 140 and slurry 150 pools in the reclaim area 20. The sand 140 will pool up and remain within the hay bale 30 and fence/reclamation structure 35 due to the reduction in the velocity of the flow of the slurry 150 and filtration. The slurry 150 continues to flow under, around, and through the hay bales 30 and the fence/reclamation structure 35 to eventually flow into a waste pit or another receiver. When only the aggregate 130 remains within the cleansed tumbler 210 the reclaim gate 50 can be closed by counter rotation of a turn plate 100. The aggregate 130 can then be removed from the tumbler 210 for reuse. The sand 140, having been filtered from the slurry 150 in the reclaim area 20 can also be reused. The rinse water 160 can also be reused after the slurry settles.

The hay bales 30 need not have any special make-up or special baled constituents. That is, almost any type of plant stem may be used. Known suitable bales include leguminous crops such as alfalfa or clover, or the use of typically inedible or unconventional plant stems such as Johnson grass or the straws of various cereal crops. As noted the hay bales 30 may be held in a preferred configuration by one (1)

or more stabilizer blocks 40. The stabilizer blocks 40 may be any type of concrete masonry unit which stabilizes the hay bales.

Referring now to FIGS. 1 and 2, the reclaim gate 50 can be added to an existing tumbler 210 of a ready-mix cement truck 200 or it can be part of a new truck. Either way the tumbler 210 would be prepared by cutting a circular tumbler aperture 215 at a location which enables the cement mixture to exit the tumbler 210. The tumbler aperture 215 should have a diameter which fits a tumbler flange aperture 55 of a tumbler flange 60. The tumbler flange 60 is an annular ring permanently attached to the tumbler 210, preferably by being welded 62 concentrically around the tumbler aperture 215. The tumbler flange 60 includes a plurality of threaded fastener apertures 65.

Refer now to FIG. 2 for an exploded view and to FIG. 3 for a sectional view of the reclaim gate 50. In the preferred embodiment the reclaim gate 50 includes a stacked assembly of circular planar members including the tumbler flange 60, a strainer 70, a fixed plate 80, and the turn plate 100.

The strainer 70 is located externally adjacent the tumbler flange 60. The strainer 70 retains the aggregate 130 within the tumbler 210 while allowing sand 140, slurry 150 and rinse water 160 to exit. The strainer 70 includes a plurality of equally-spaced strainer reclaim apertures 75 that are sized to limit exodus of the aggregate 130 while allowing the sand 140, slurry 150 and rinse water 160 to pass through. The strainer 70 is preferably formed using a circular section of an expanded metal plate. The strainer 70 also includes a central strainer pivot aperture 77. The central strainer pivot aperture 77 is large enough to receive a nut fastener 120 (see FIG. 3).

The fixed plate 80 has a perimeter edge 113 which protrude perpendicularly toward the tumbler flange 60, thereby forming an 'L"-shaped cross-section perimeter. The "L"-shaped perimeter edge 113 encompasses and retains the circular strainer 70 in parallel between the fixed plate 80 and the tumbler flange 60. The fixed plate 80 has a plurality of fixed plate reclaim apertures 85 for enabling the passage of the sand 140, slurry 150 and rinse water 160 admixture. The fixed plate reclaim apertures 85 are beneficially arranged in a uniform circular pattern around the fixed plate 80. The fixed plate 80 further includes a centrally located fixed plate pivot aperture 95 and a plurality of fastener apertures 65. The fixed plate 80 is attached to the tumbler flange 60 using a plurality of threaded plate fasteners 90 that pass through the threaded fastener apertures 65.

The turn plate 100 is rotatingly attached to the fixed plate 80 along a common center axis via an axle-like gate actuator 115. The gate actuator 115 is a threaded 118 connector that passes through a turn plate pivot aperture 110 in the turn plate 100, through the fixed plate pivot aperture 95 and into the central strainer pivot aperture 77 where it threads onto the nut fastener 120. Beneficially the nut fastener 120 is distorted after receiving the gate actuator 115 such that the nut fastener 120 cannot vibrate or come off the gate actuator 115.

The turn plate 100 has a plurality of turn plate reclaim apertures 105 that are sized and spaced to be able to match the locations and sizes of the fixed plate reclaim apertures 85. A flow of sand 140, slurry 150 and rinse water 160 from the tumbler 210 is enabled by rotating the turn plate 100 relative to the fixed plate 80 via the gate actuator 115 (described in more detail subsequently) so as to align the turn plate reclaim apertures 105 with the fixed plate reclaim apertures 85. When aligned, the sand 140, slurry 150 and rinse water 160 can exit the tumbler 210. To prevent the sand 140 and slurry 150 from leaving the tumbler 210 the reclaim gate 50 can be closed by counter rotation of the turn plate 100 such that the fixed plate reclaim apertures 85 and turn plate reclaim apertures 105 are not aligned.

Referring now primarily to FIG. 2, as noted the fixed plate pivot aperture 95 and the turn plate pivot aperture 110 are joined together yet can turn relative to one another via the gate actuator 115. To that end the turn plate pivot aperture 110 includes a keyway 112 along a perimeter edge. The gate actuator 115 is configured with a protruding key 117. The gate actuator 115 is routed through the plate pivot aperture 110, through the pivot aperture 95, through the strainer pivot aperture 77 and into the nut fastener 120 such that the key 117 inserts into the keyway 112. As the gate actuator 115 is turned it and the turn plate 100 rotate together.

In practice an actuator tool 125 is used to rotate the gate actuator 115. The actuator tool 125 provides needed leverage and is preferably an open-end wrench appropriate to the size of a head on the gate actuator 115. As the gate actuator 115 is turned using the actuator tool 125 the turn plate 100 is rotated.

It is envisioned that other styles and configurations of the present invention can be easily incorporated into the teachings of the present invention; only one particular configuration is shown and described for purposes of clarity and disclosure and not by way of limitation of scope.

The method of installing the reclaim gate 50 may be achieved by performing the following: procuring the reclaim gate 50; determining a suitable location upon a cement truck tumbler 210 for the reclaim gate 50 so as to enable removal of the cement sand 140 and slurry 150 and rinse water 160; cutting a tumbler aperture 215 through the tumbler 210; aligning the tumbler flange 60 to the tumbler flange aperture 55; welding the tumbler flange 60 to the tumbler 210; pre-assembling the turn plate 100 and the fixed plate 80, by inserting the gate actuator 115 through the turn plate pivot aperture 110 and the fixed plate pivot aperture 95; securing the turn plate 100 and fixed plate 80 together by installing and tightening the nut fastener 120 onto the threaded region 118 of the gate actuator 115; deforming the threaded region to prevent the nut fastener 120 from coming off; placing the strainer 70 into the recessed area of the fixed plate 80; and, mounting the turn plate 100, fixed plate 80, and strainer 70, as an assembly, onto the tumbler flange 60 by inserting and tightening the plate fasteners 90. The reclaim gate 50 is then ready for use.

The method 10 may be achieved by performing the following steps: parking a cement truck 200 proximity to a reclaim area 20; stopping the rotation of the tumbler 210 so as to orient the tumbler 210 at a suitable position for dispensing the constituents of the contained concrete mix; opening the tumbler 210 to allow the cement sand 140 and slurry 150 to pass through strainer openings that are too small to allow the aggregate 130 to pass; rinsing the contained cement with rinse water 160 to clean an interior portion of the tumbler 210 and to dilute the remaining cement mixture; allowing sand 140, slurry 150, and rinse water 160 to pass through the strainer openings and thus to flow from the tumbler 210; leaving the aggregate 130 in the tumbler 210; passing the sand 140, slurry 150, and rinse water 160 into the reclaim area 20; filtering the sand to remain in the reclaim area; passing the slurry 150 out of the reclaim area 20, settling the slurry 150, and recovering the aggregate 130, sand 149, and rinse water 160.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A reclaim gate comprising:

a tumbler flange having a tumbler flange opening;

a strainer adjacent said tumbler flange, said strainer having a central strainer pivot aperture and a screen having strainer openings;

a fixed plate entrapping said strainer adjacent said tumbler flange, said fixed plate rigidly attached to said tumbler flange by threaded fasteners, said fixed plate having a central fixed plate aperture and a fixed plate reclaim aperture aligned with said screen;

a rotating turn plate having a central turn plate aperture and a turn plate reclaim aperture; and, a gate actuator that passes through said central turn plate aperture, through said central fixed plate aperture and into said central strainer pivot aperture;

wherein said gate actuator retains said turn plate adjacent said fixed plate such that said turn plate can turn to selectively align said central turn plate aperture with said central fixed plate aperture; wherein said tumbler flange is welded to a truck.

2. The reclaim gate according to claim 1, wherein said tumbler flange includes threaded fastener apertures for receiving said threaded fasteners.

3. The reclaim gate according to claim 1, wherein said strainer openings are not large enough to allow wet cement aggregates to pass through but are large enough to allow sand, slurry, and rinse water to pass through.

4. The reclaim gate according to claim 1, wherein said fixed plate includes an L-shaped perimeter for entrapping said strainer adjacent said tumbler flange.

5. The reclaim gate according to claim 1, wherein said central turn plate aperture includes a keyway and said gate actuator includes a key that fits into said keyway such that turning said gate actuator turns said turn plate.

6. The reclaim gate according to claim 1, further including a nut fastener in said central strainer pivot aperture retaining said gate actuator to said fixed plate and to said turn plate.

7. A ready mix cement truck comprising:

a rotating tumbler on a truck frame, said rotating tumbler having a tumbler aperture;

a tumbler flange having a tumbler flange opening aligned with said tumbler aperture, said tumbler flange being permanently attached to said tumbler;

a strainer adjacent said tumbler flange aperture, said strainer having a central strainer pivot aperture and a screen having strainer openings;

a fixed plate entrapping said strainer adjacent said tumbler flange, said fixed plate rigidly attached to said tumbler flange by threaded fasteners, said fixed plate having a central fixed plate aperture and a fixed plate reclaim aperture aligned with said screen;

a rotating turn plate having a central turn plate aperture and a turn plate reclaim aperture; and, a gate actuator that passes through said central turn plate aperture, through said central fixed plate aperture and into said central strainer pivot aperture;

wherein said gate actuator retains said turn plate adjacent said fixed plate such that said turn plate can turn to selectively align said central turn plate aperture with said central fixed plate aperture.

8. The reclaim gate according to claim 7, wherein said tumbler flange includes threaded fastener apertures for receiving said threaded fasteners.

9. The reclaim gate according to claim 7, wherein said tumbler flange is welded to the tumbler.

10. The reclaim gate according to claim 7, wherein said strainer openings are not large enough to allow wet cement aggregates to pass through but are large enough to allow sand, slurry, and rinse water to pass through.

11. The reclaim gate according to claim 7, wherein said fixed plate includes an L shaped perimeter for entrapping said strainer adjacent said tumbler flange.

12. The reclaim gate according to claim 7, wherein said central turn plate aperture includes a keyway and said gate actuator includes a key that fits into said keyway such that turning said gate actuator turns said turn plate.

13. The reclaim gate according to claim 7, further including a nut fastener retaining said gate actuator to said fixed plate and to said turn plate.

* * * * *